US007892154B1

(12) United States Patent
Alexa

(10) Patent No.: US 7,892,154 B1
(45) Date of Patent: Feb. 22, 2011

(54) SHOCK ABSORBER ANKLE EXERCISE DEVICE

(76) Inventor: Austen Alexa, 113521 Rachael Ct., Hinsdale, IL (US) 60521

( * ) Notice: Subject to any disclaimer, the term of this patent is extended or adjusted under 35 U.S.C. 154(b) by 17 days.

(21) Appl. No.: 12/380,932

(22) Filed: Mar. 5, 2009

Related U.S. Application Data

(63) Continuation-in-part of application No. 11/810,808, filed on Jun. 7, 2007, now abandoned.

(60) Provisional application No. 60/811,462, filed on Jun. 7, 2006.

(51) Int. Cl.
*A63B 21/008* (2006.01)
*A63B 23/08* (2006.01)

(52) U.S. Cl. ..... 482/112; 482/79

(58) Field of Classification Search ..... 482/79, 482/80, 111, 112, 113, 122–124, 129–130, 482/133, 139, 908, 910; 601/31–35
See application file for complete search history.

(56) References Cited

U.S. PATENT DOCUMENTS 2,109,188 A * 2/1938 Bajanova ..... 482/69
2,493,027 A * 1/1950 Price ..... 482/76
2,815,020 A * 12/1957 Barkschat ..... 601/26
2,862,710 A * 12/1958 Lewis ..... 472/14
3,702,188 A 11/1972 Phillips et al.
3,758,112 A 9/1973 Crum et al.
4,074,446 A * 2/1978 Eisenberg ..... 36/117.5
4,186,920 A * 2/1980 Fiore et al. ..... 482/79
4,452,447 A 6/1984 Lepley
4,605,220 A 8/1986 Troxel
4,650,183 A 3/1987 McIntyre
4,707,934 A * 11/1987 Hart ..... 36/7.8
4,836,538 A * 6/1989 Rice ..... 482/147
4,875,684 A * 10/1989 Benilan ..... 473/279
5,152,732 A * 10/1992 Sayre ..... 482/133
5,368,536 A 11/1994 Stodgell
5,403,254 A * 4/1995 Lundin et al. ..... 482/52
D362,479 S * 9/1995 Destasio, Jr. ..... D21/688
5,583,407 A 12/1996 Yamaguchi
5,722,919 A * 3/1998 Timmer ..... 482/79
5,803,880 A 9/1998 Allen
5,879,276 A * 3/1999 Miller ..... 482/146
5,902,214 A * 5/1999 Makikawa et al. ..... 482/4
6,045,486 A * 4/2000 Jensen ..... 482/27
6,162,150 A * 12/2000 Lee ..... 482/51
6,270,414 B2 * 8/2001 Roelofs ..... 463/36

(Continued)

*Primary Examiner*—Loan Thanh
*Assistant Examiner*—Daniel F Roland
(74) *Attorney, Agent, or Firm*—Montgomery Patent and Design; Robert C. Montgomery

(57) ABSTRACT

An apparatus and method designed to strengthen, develop, and rehabilitate the anatomy of the human ankle is herein disclosed, comprising a large stable floor base and a plurality of resistant shock absorber-like members extending therefrom a foot securing platform. A user's foot is placed thereon and connected thereto the foot platform by toe and heel cuffs. Each motion resistant cylinder has adjustment means for reducing or adding resistance. In use, the attached lower leg and foot is restrained in all planar and vertical axes; however, the user is able to move their foot in a vertical and orbital manner against the resistance of the cylinders resulting in rehabilitation and/or strengthening of the muscles, tendons and ligaments surrounding the ankle. Improving ankle strength and mobility using this apparatus would have athletic, fitness, and therapeutic benefits.

7 Claims, 7 Drawing Sheets

U.S. PATENT DOCUMENTS

| | | | | |
|---|---|---|---|---|
| 6,277,057 | B1 | 8/2001 | Hayden | |
| 6,409,690 | B1 * | 6/2002 | Chen | 601/126 |
| 6,692,414 | B1 | 2/2004 | Gelbart et al. | |
| 6,740,011 | B1 * | 5/2004 | Tsai et al. | 482/80 |
| 6,821,235 | B1 | 11/2004 | Johnson | |
| 7,118,519 | B2 * | 10/2006 | Slowinski | 482/146 |
| 7,322,914 | B1 * | 1/2008 | Vittone et al. | 482/146 |
| 2006/0240955 | A1 * | 10/2006 | Pu | 482/79 |

* cited by examiner

SHOCK ABSORBER ANKLE EXERCISE DEVICE

RELATED APPLICATIONS

This present invention is a continuation-in-part application of Ser. No. 11/810,808 filed Jun. 7, 2007 now abandoned; which in turn is a complete application claiming benefit of U.S. Provisional 60/811,462 filed Jun. 7, 2006.

FIELD OF THE INVENTION

The present invention relates generally to a physical exercise apparatus and, more particularly, to a shock absorption apparatus for developing, strengthening or rehabilitating the human ankle.

BACKGROUND OF THE INVENTION

The present invention relates generally to a physical exercise apparatus and, more particularly, to a shock absorption apparatus for developing, strengthening or rehabilitating the human ankle.

Physical fitness and health concerns are among the areas of highest concern among Americans today. More than ever, people are frequenting health clubs and performing exercise routines at home in order to lose weight, improve muscle tone and maintain a healthy lifestyle. One (1) area of the body that many individuals often overlook however is that of the ankle area. This is especially ironic when one considers the amount of people affected by ankle injuries. Typical health clubs, workout areas, and the like are filled with equipment and machines to help build and strengthen other areas of the body, but ankle only machines are strangely absent. This phenomenon also impacts those who have already suffered from an ankle injury or are recovering from surgery and are looking to rehabilitate their ankle areas.

Several attempts have been made in the past to develop a shock absorption apparatus for developing, strengthening or rehabilitating the human ankle. U.S. Pat. No. 6,821,235, in the name of Johnson et al, discloses a device that includes a foot-engaging element that can move in a spherical pattern and has resistance to movement generated by elastic straps. The straps can be added, changed or removed to customize the resistance to the exact pattern required to achieve maximum benefit for the user. The device does not require a user to place his or her weight on their foot to exercise, strengthen or rehabilitate an ankle. Unfortunately, the shape of the base of this prior art example does not provide a stable platform for use of the invention.

U.S. Pat. No. 5,368,536, in the name of Stodgell, discloses an ankle rehabilitation device providing for exercise movement duplicating the complete range of ankle movement including plantar and dorsi flexion, inversion, eversion and rotation. The amount of resistance to movement and the direction of resistance may be changed without disattaching the foot from the device. A tensioning device is also provided to permit use of the device for isometric exercise of the ankle. An ankle rehabilitation device according to one (1) embodiment of the invention comprises a base, a support post mounted to the base, a base plate rotatably mounted to the support post, a foot receiving platform universally mounted on top of the support post, and a two-bar linkage mounted at one end to the base plate and at the other end to one (1) of a plurality of attachment points on the foot receiving platform. A coil-spring is operatively connected between the bars of the linkage. Unfortunately, this prior art example requires the user to stand on one (1) foot while exercising the other foot which may not be feasible for a person with an injury to both legs or feet.

U.S. Pat. No. 5,803,880, in the name of Allen, describes a stepper/climber machine that includes a frame supported on a base with the frame being comprised of first and second hollow columns connected to a hollow cross-beam. Within the first and second hollow columns, there are first and second rigid struts, respectively. Each of the rigid struts has a foot pedal and handgrip fixed thereto. The rigid struts are connected by a cable which is trained through the hollow cross-beam so that as one (1) strut moves upwardly, the other strut moves downwardly, thereby raising one handgrip and pedal while allowing the other handgrip and pedal to lower. The first and second struts are connected to one another through a hydraulic circuit which includes a branched portion with legs having opposed one-way check valves in series with solenoid valves. A selector determines the lengths of the strokes by opening and closing the solenoid valves alternately so that fluid can only flow in one direction through the hydraulic circuit. In this way, the person using the stepper/climber exercise machine must cycle the machine through complete strokes instead of being able to shorten the strokes as the exercise proceeds, allowing the person using the machine to optimize their workout. The hydraulic circuit also includes an adjustable valve which allows the user to increase or decrease the resistance to flow, and thus the resistance encountered during the exercise routine. Unfortunately, this prior art example is not designed for rehabilitation of an ankle from an injury.

U.S. Pat. No. 3,758,112 in the name of Crum et al, discloses a foot pedal operated exercising device containing a dynamometer formed of a pair of cylinders each containing a piston. The pistons are linked to each other. The upper portions of the two (2) cylinders are joined together by a common opening to provide a common fluid reservoir and each piston is provided with a one-way check valve to maintain an adequate supply of working fluid. Fluid from the driven cylinder is transmitted to the other cylinder through separate constant force spring biased valves each valve takes the predominant portion of the pressure drop thereby providing a constant force hydraulic dynamometer. A device is provided to determine the amount of movement of piston travel. Unfortunately, this prior art example provides a severely restricted range of exercise motion.

None of the prior art particularly describes a shock absorption apparatus for developing, strengthening or rehabilitating the human ankle. Accordingly, there is a need for an apparatus which provides such features while overcoming the above-noted shortcomings.

SUMMARY OF THE INVENTION

In view of the foregoing disadvantages inherent in the aforementioned references, it has been observed that there is need for and it is the object of the present invention to provide a shock absorption apparatus for developing, strengthening or rehabilitating the human ankle.

To achieve the above objectives, it is the object of the present invention to provide a unique physical exercise apparatus which is primarily designed to strengthen and develop the ankle area of the human body. The invention provides a large base for stability which sits on the floor. Four (4) hydraulic or possibly pneumatic cylinders are equidistantly spaced around the outer perimeter of the base and extend upward and inward to support a footrest. One (1) cylinder is located in the center of the base and extends upward to support the footrest. A footrest assembly is the size of a typical adult's foot and is provided with a toe cuff and size adjustable heel cuff. The user's foot is supported in a manner which provides adjustable resistance to movement in a full range of motion and thus the user is able to move their foot about against the resistance of the hydraulic or pneumatic cylinders. In doing so, the user will build strength in all muscles, tendons, ligaments and the like about the ankle area. Such a workout is envisioned to be not only beneficial for athletes, but for those who have undergone ankle surgery, and/or are trying to rehabilitate their ankle. The use of the innovative apparatus allows virtually anyone to rehabilitate or strengthen their ankle area in a manner efficiently.

Another object of the present invention is to provide an ankle exercising apparatus for rehabilitating lower leg muscles includes a base member that has a planar bottom surface and a plurality of adjustable hydraulic cylinders adaptable along an orbital direction and directly coupled to the base member, without the use of intervening elements, in such a manner top ends of the outer perimeter hydraulic cylinders converge upwardly towards a center of the base member. Such a base member includes a rectilinear center base support spanning across a diameter of the base member and the center hydraulic cylinder vertically connects the base support to the footrest.

Yet still another object of the present invention is to provide each of such outer hydraulic cylinders which are equidistantly spaced from each other and include a shaft resiliently compressible along a linear path angled outwardly and downwardly from the footrest assembly. An external resistance adjustment is mated to the shaft, and a lower ball end joint is anchored to the base member. The resistance adjustment includes a cylindrical collar located along an external surface of the outer hydraulic cylinder body for adjusting a tension of the hydraulic cylinder.

Yet still another object of the present invention is to provide the center hydraulic cylinder which includes a shaft resiliently compressible along a linear path downwardly from the footrest assembly. An external resistance adjustment is mated to the shaft, and a lower end is anchored to the base support member. The resistance adjustment includes a cylindrical collar located along an external surface of the center hydraulic cylinder body for adjusting a tension of the hydraulic cylinder.

Yet still another object of the present invention is to provide the apparatus including an adjustable footrest assembly supported above the base member and operably engaged with the hydraulic cylinders, and a mechanism for attaching the hydraulic cylinders to the footrest assembly and the base member. Each of the hydraulic cylinders is independently compressible along a linear path based upon an external force exerted by the user during movement along the orbital or vertical direction. The footrest assembly provides a means of length adjustment comprising toe cuff and adjustable heel cuff which enables for a larger and smaller foot.

Yet still another object of the present invention is to provide an attaching mechanism which includes a footrest and a support post ball joint anchored to the footrest. An upper support post is attached to the support post ball joint, and a height adjustment collar is coupled to the upper support post. A lower support post is coupled to the upper support post, and a post bracket is coupled to the lower support post and the base member respectively. The upper support post extends downwardly from the support post ball end joint, which is essential such that the upper support post moves slidingly within the lower support post in a telescoping manner.

Yet still another object of the present invention is to provide a footrest attaching mechanism which includes a plurality of upper ball end joints coupled to the cylinder shafts and a plurality of cylinder adjustment swivel joints mated to the upper ball end joint. A plurality of adjustment brackets is secured to the base member and a plurality of knurled attachment knobs is operably attached to the adjustment brackets. A plurality of adjustment rods is threadingly connected to the adjustment brackets, and a plurality of adjustment knobs is coupled to the adjustment rods. A plurality of adjustment swivel joints is attached to the swivel joint. The adjustment swivel joints travel along respective lengths of the adjustment rods as the adjustment rods are rotated clockwise or counterclockwise by utilizing the adjustment knobs to thereby provide angular adjustment of the hydraulic cylinders.

Yet still another object of the present invention is to provide a toe cuff and a heel cuff which are attached to the footrest assembly. The heel cuff includes a heel cuff base which provides a means of adjustably securing the heel cuff to the footrest and a vertically extending semi-rigid panel which wraps around a user's heel and extends perpendicularly upward.

Yet still another object of the present invention is to provide the base comprising a plurality of base anchoring apertures or vertical through holes in the outer perimeter which provides a means of securely anchoring the base to a permanent structure or a transportable platform assembly.

Yet still another object of the present invention is to provide the platform assembly which provides a larger and more stable transportable structure for the base to securely attach during use. The base can be temporally mounted to the platform assembly during use by a plurality of wing bolt fasteners and wing bolt apertures which align with the base anchoring apertures to secure the base to the platform. The platform assembly also comprises a large platform hinge which provides a means of collapsing the platform for convenient storage and ease of transport.

Yet still another object of the present invention is to provide a stabilizing handle assembly which removably attaches to the platform and provides the user with the ability to use the use the ankle exercise apparatus in a standing position by providing a posture support to the user. The handle assembly connects to a mounting bracket on a top surface of the platform assembly. In such a manner the additional benefit of being able to utilize the invention in a seated or a standing position is provided.

Yet still another object of the present invention it to provide a an unexpected benefit of allowing a user to selectively rehabilitate their ankle by rotating their lower leg along an orbital, vertical, and rotational path such that independent tension is exerted on the muscles to improve the strength and coordination of major muscle groups at the ankle.

Yet still another object of the present invention is to provide a method of utilizing an ankle exercising device includes the steps of mounting a footrest assembly to a plurality of adjustment brackets and a center post using knurled attachment knobs, telescopically adjusting an upper support post to a desired height by adapting a support post height adjustment collar and associated fasteners, placing a user foot on the footrest assembly by adapting a toe cuff and a strap respectively, affixing and adjusting the toe cuff and the strap by adapting a plurality of toe cuff attachments and a plurality of strap attachments to a snug position, adjusting an angle and an amount of resistance of the hydraulic cylinders by adjusting a plurality of adjustment knobs and resistance adjustment collars associated therewith, and moving the user ankle in a desired orbital path for isolating particular muscles. The method further includes the steps of removing the user's foot upon completion of an exercising routine, detaching the footrest assembly by loosening the knurled attachment knobs, and folding the hydraulic cylinders to a flat and compact position upon a base member.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
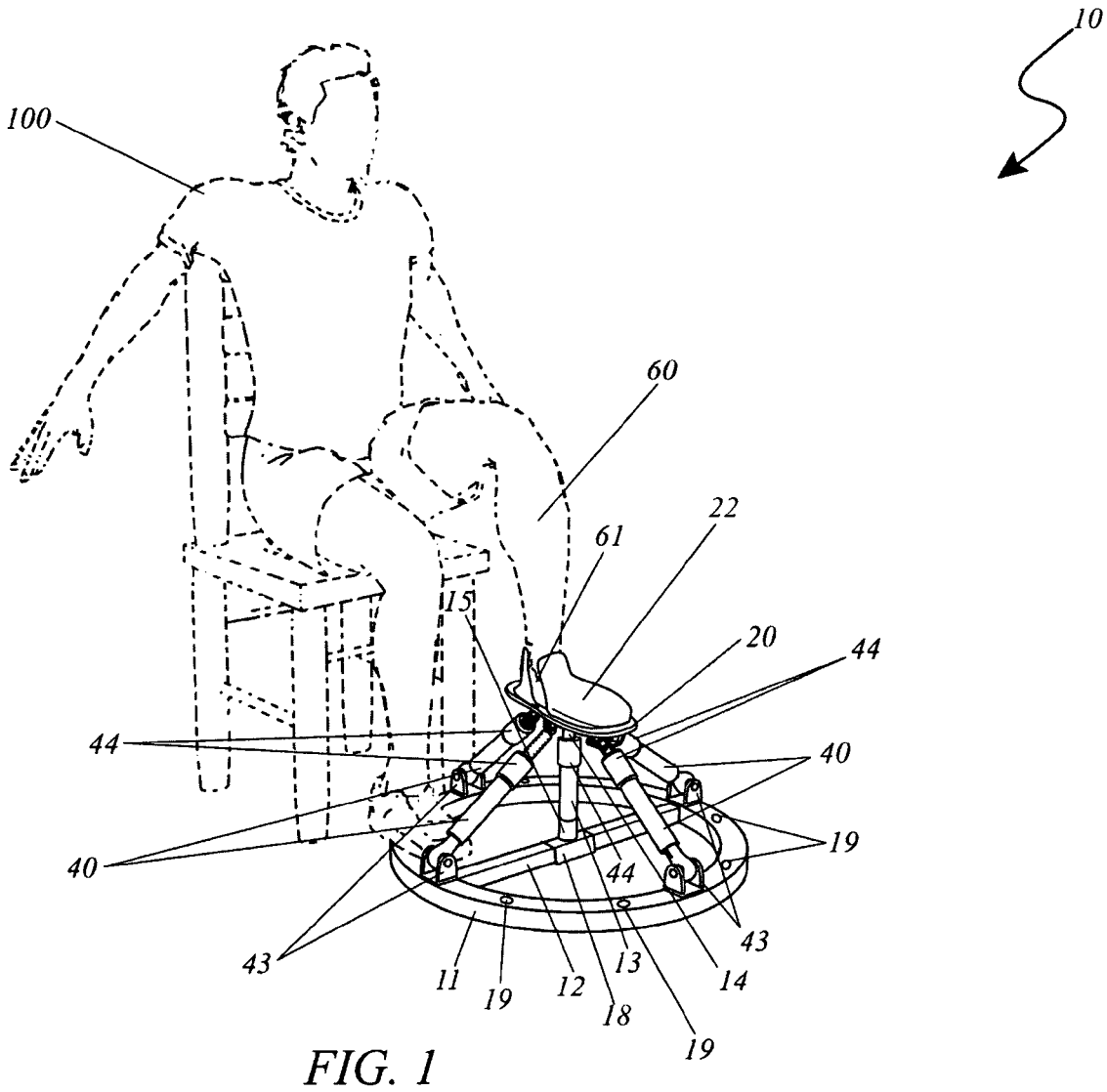
FIG. 1 is an environmental view of a shock absorber ankle exerciser 10, according to the preferred embodiment of the present invention.

| | |
|---|---|
| 10 | shock absorber ankle exerciser |
| 11 | base |
| 12 | base center support |
| 13 | center hydraulic cylinder |
| 14 | first upper shaft |
| 15 | lower support post |
| 16 | center hydraulic cylinder ball joint |
| 17 | friction pad |
| 18 | post bracket |
| 19 | base anchoring apertures |
| 20 | footrest |
| 22 | toe cuff |
| 23 | heel cuff |
| 25 | heel cuff base |
| 27 | heel cuff anchoring aperture |
| 29 | common fastener |
| 30 | cylinder adjustment knob |
| 31 | cylinder adjustment bracket |
| 32 | cylinder adjustment rod |
| 33 | knob/stud fastener |
| 40 | outer hydraulic cylinder |
| 41 | cylinder adjustment swivel joint |
| 42 | lower ball end joint |
| 43 | cylinder bracket |
| 44 | resistance adjustment |
| 45 | second upper shaft |
| 48 | upper ball end joint |

-continued

| | |
|---|---|
| 50 | heel support member |
| 60 | foot/ankle |
| 61 | shoe |
| 70 | platform assembly |
| 72 | first platform portion |
| 74 | second platform portion |
| 75 | anti-skid pad |
| 76 | platform hinge |
| 78 | wing bolt fastener |
| 79 | wing bolt aperture |
| 80 | weight post |
| 82 | weight |
| 85 | stabilizing handle assembly |
| 87 | mounting bracket |
| 88 | threaded region |
| 89 | upper handle member |
| 91 | lower handle member |
| 93 | locking collar |
| 95 | grip |
| 100 | user -- |

Detailed Description of the Preferred Embodiment

The best mode for carrying out the invention is presented in terms of its preferred embodiment, herein depicted within FIGS. 1 through 6*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that strengthens, develops, and/or rehabilitates the anatomy of a human ankle and lower leg 60. The shock absorber ankle exercise device (herein described as the "apparatus") 10 comprises a stable circular base 11 configuration, five (5) adjustable hydraulic cylinders, an adjustable footrest assembly 20, and a means of appending a foot member 60, thereby providing a resistance motioning means thereto an ankle portion 60. The apparatus 10 is fabricated using a plurality of metals, plastics, or other materials suitable for the application. The apparatus 10 may be utilized by athletes, body-builders, rehabilitants, and/or other users 100 desiring ankle strengthening and reconditioning.

Referring now to FIG. 1, an environmental view of the apparatus 10, according to the preferred embodiment of the present invention, is disclosed. Illustrated here is a user 100 restraining an ankle portion 60 thereto the apparatus 10 in a seated position for therapeutic treatment, strengthening, rehabilitation, and similar purposes; however, the apparatus 10 may also be utilized with equal benefit in a standing position if desired. The apparatus 10 provides an attachment means to said foot/ankle 60 by insertion and securing of a user's shoe 61 thereupon a footrest platform 20 via a stationary toe cuff 22 and an adjustable heel cuff 23. The user 100 may customize particular strengthening or developmental treatments via a center hydraulic cylinder 13 and four (4) outer hydraulic cylinders 40 which provide adjustable resistance as said user 100 moves a foot/ankle 60 in an orbital and vertical fashion. Thus, the user 100 is able to move a foot/ankle member 60 against the resistance of the hydraulic cylinders 13, 40 resulting in a healthy increase of strength to the muscles, tendons, and ligaments surrounding the ankle 60.

Figure 6A:
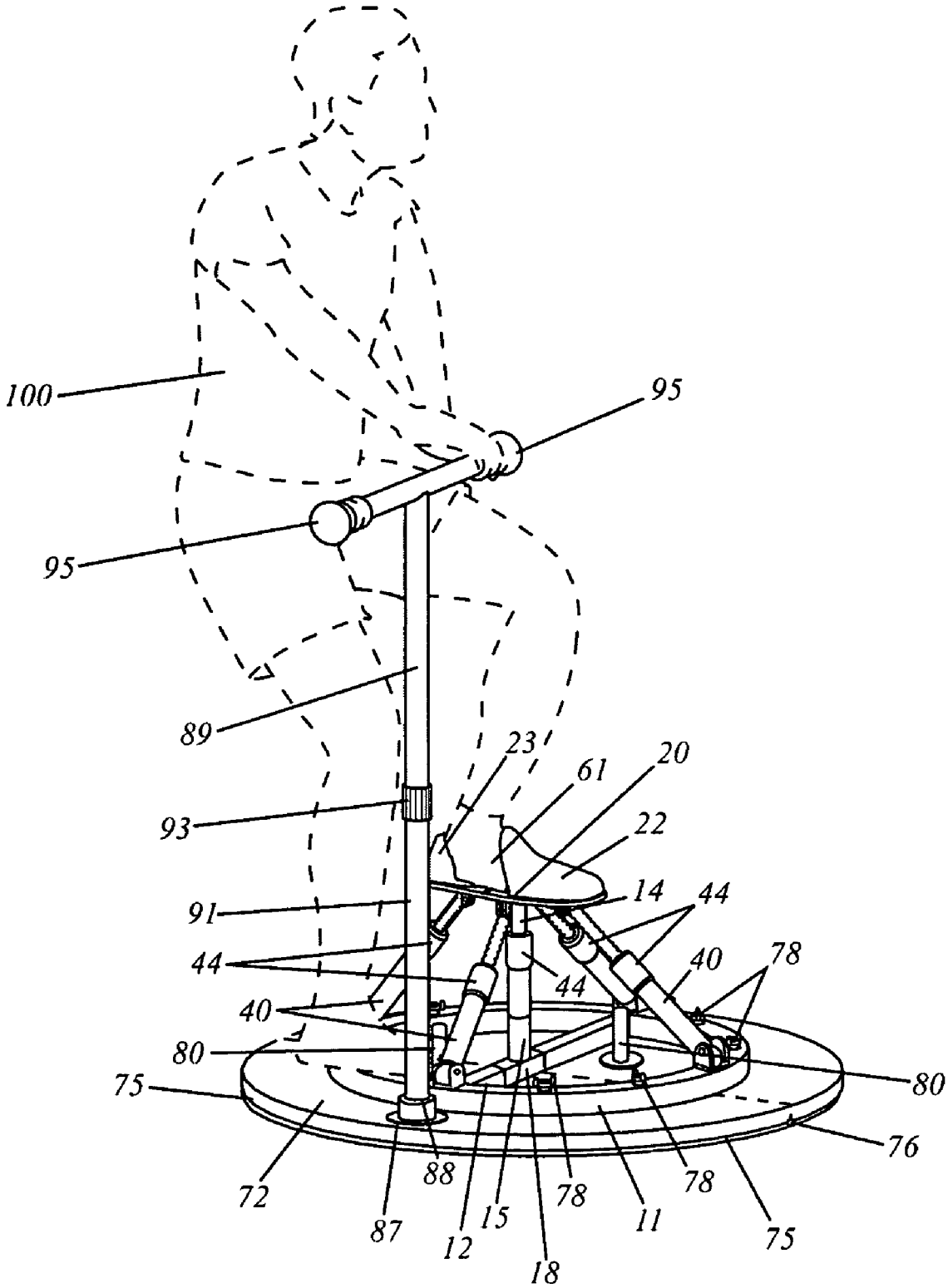
FIG. 6*a* is an environmental view of the shock absorber ankle exerciser 10 depicting attachment of a platform base portion 20, according to the preferred embodiment of the present invention; and, FIG. 6*b* is a perspective view of a platform base portion 20 of the shock absorber ankle exerciser 10, according to the preferred embodiment of the present invention.
Figure 6B:
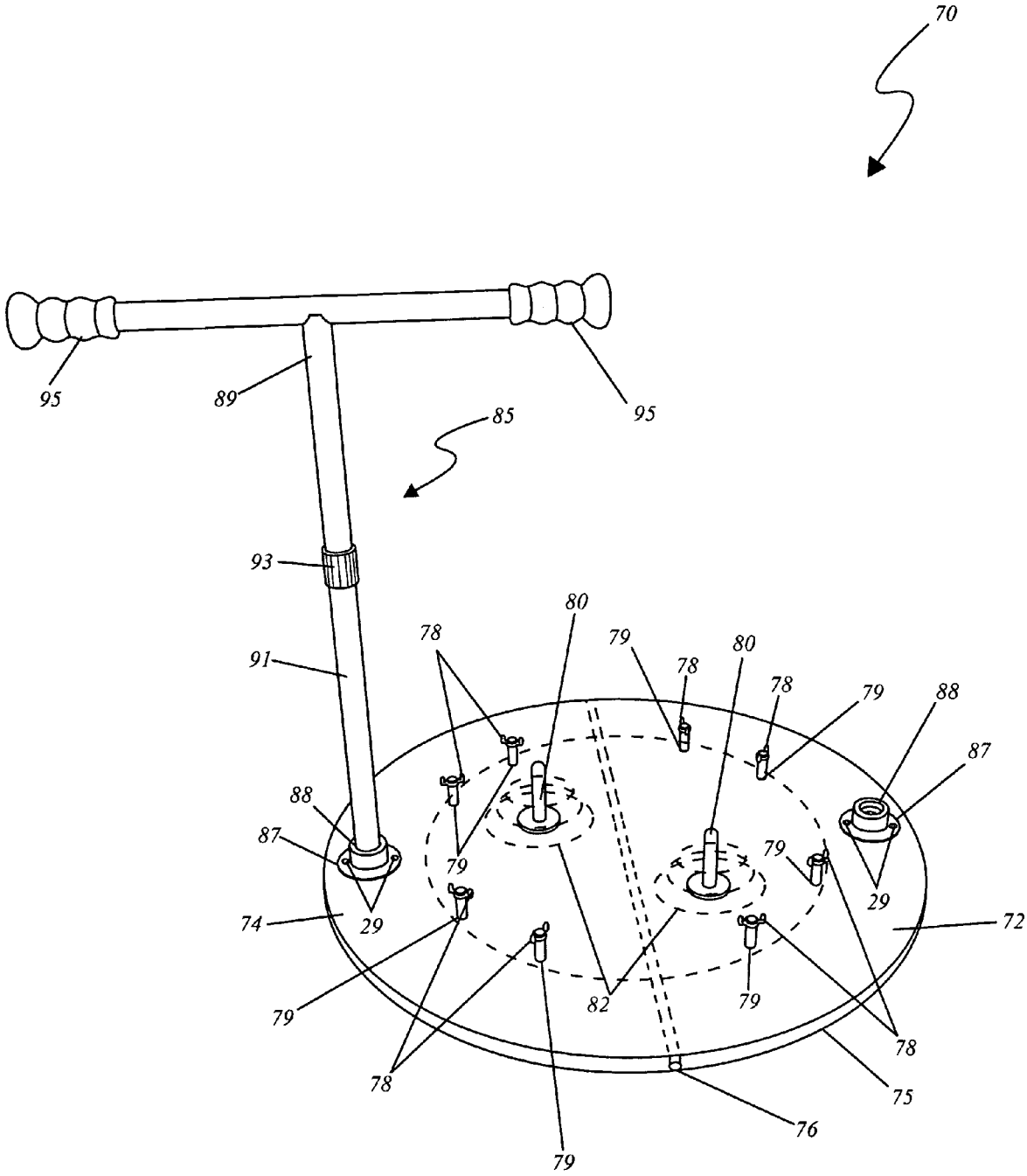

The apparatus 10 is held securely to a floor surface during use by a circular base portion 11 having an approximate diameter of twenty-four (24) inches, or by subsequent attachment thereto a platform assembly 70 designed to provide additional stability (see FIGS. 6*a* and 6*b*). The base 11 provides a low center of gravity means as well as a rubberized friction pad 17 approximately one-quarter (¼) inch thick mounted along a subjacent surface using fastening methods such as adhesives, screws, rivets, or the like. The base 11 further comprises a plurality of base anchoring apertures 19 which provide an attachment means of the apparatus 10 thereto a floor surface, a wall surface, or thereto the platform assembly 70 (see FIGS. 6*a* and 6*b*). Also, the circular design of the base 11 provides an even distribution of an applied downward force which will minimize motion of the base 11 during utilization of the apparatus 10. The base 11 is envisioned to be made using rugged materials such as stainless steel, painted or plated steel, or the like.

Figure 2:
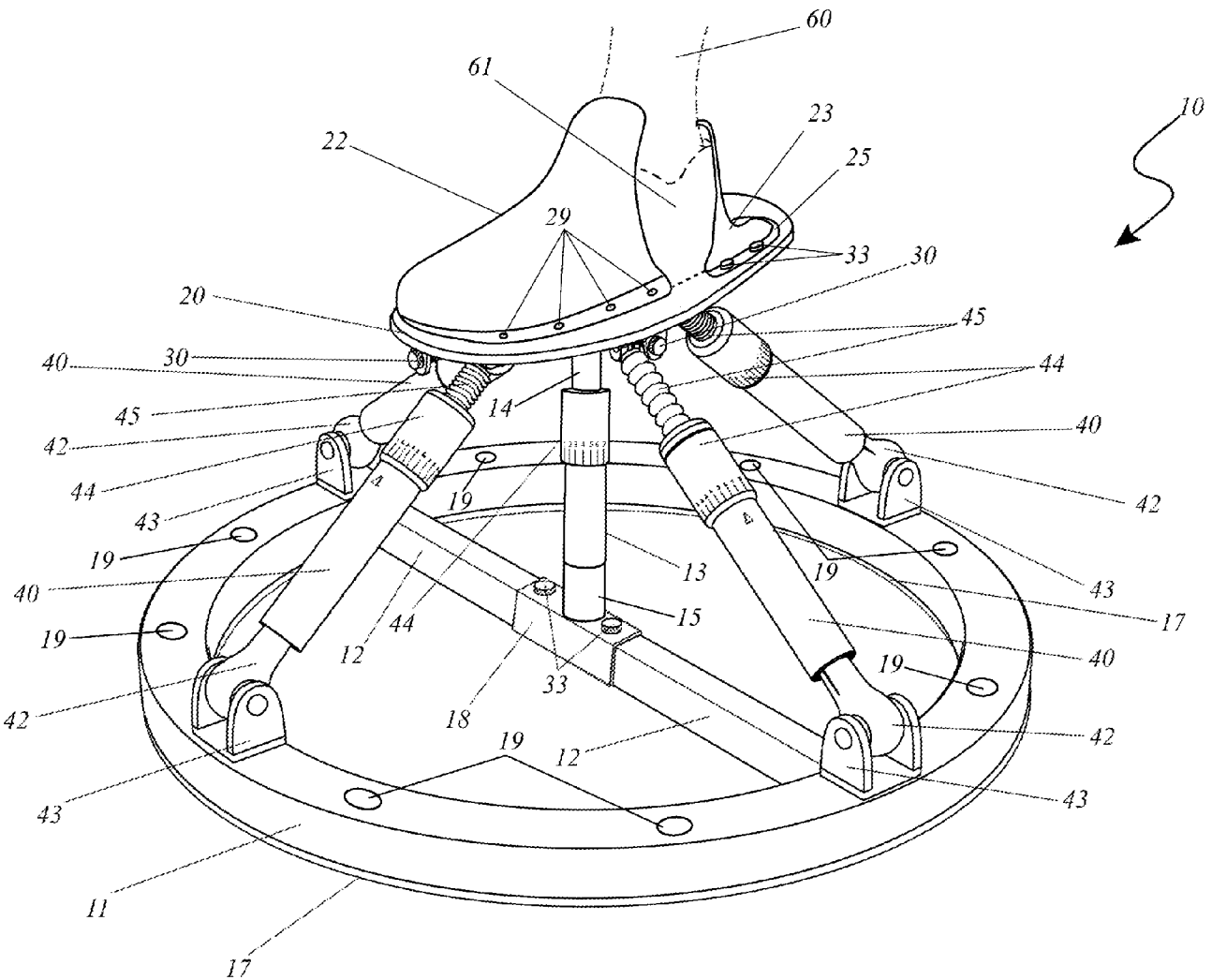
FIG. 2 is a perspective view of a shock absorber ankle exerciser 10, illustrated with a left foot member 60 affixed thereto a footrest 20, according to the preferred embodiment of the present invention.

Referring now to FIG. 2, a perspective view of the apparatus 10 illustrated with a left foot member 60 affixed thereto a footrest portion 20, according to the preferred embodiment of the present invention, is disclosed. Along a bottom surface, the footrest 20 provides mechanical attachment thereto a vertically compressible center hydraulic cylinder 13 further comprising a center hydraulic cylinder ball joint 16 (see FIG. 3), a first upper shaft 14, a lower support post 15, a resistance adjustment 44, and a post bracket 18. Also attached along a bottom surface of the footrest 20 are four (4) outer hydraulic cylinders 40 providing a dampening resistance thereto orbital movement of the footrest 20 portion, thereby functioning in a manner similar to an automotive shock absorber. Each outer hydraulic cylinder 40 is mounted equidistantly from each other and comprises a second upper shaft 45, a manual resistance adjustment 44, and a lower ball end joint 42. The second upper shaft 45 comprises an extendable dampening rod in an expected manner. The second upper shaft 45 further provides an attachment means thereto the footrest 20 via a upper ball end joint 48 and a cylinder adjustment swivel joint 41 (see FIG. 3). The second upper shaft 45 is envisioned to be covered by a protective boot providing protection to the user 100 while providing a dust and/or dirt barrier to the outer hydraulic cylinder 40. The resistance adjustment 44 comprises a cylindrical collar located along an external surface of the outer hydraulic cylinder body 40 providing a rotational and settable adjustment means to the dynamic effect of the outer hydraulic cylinder 40. The resistance adjustment 44 further provides a minimum of eight (8) numeric graduations being printed or etched thereupon, thereby providing repeatable incremental adjustment of said dampening effect of the respective outer hydraulic cylinder 40. The outer hydraulic cylinder 40 further provides an orbital attachment means at a lower end to the base 11 via a lower ball end joint 42 and a cylinder bracket 43. The lower ball end joint 42 is envisioned to be a commercially available hardware item common in the industry. The cylinder bracket 43 is envisioned to be a "U"-shaped bracket providing an avail attachment means to the lower ball end joint 42 and upper facing surface of the base 11 using standard hardware components such as bolts, screws, rivets, or the like.

The compressible center hydraulic cylinder 13 is attached thereto a bottom horizontal surface of the footrest 20 via a center hydraulic cylinder ball joint 16 located at a central location thereupon. The center hydraulic cylinder 13 provides an adjustable hydraulic dampening resistance in a similar manner as the aforementioned outer hydraulic cylinders 40 via the integral resistance adjustment 44; however, said center hydraulic cylinder 13 further comprises an internal compression spring providing an upward pressure thereto the footrest 20 during training/therapy, as well as acting to return the footrest 20 thereto a raised state after use. The center hydraulic cylinder 13 constrains the footrest 20 therealong a vertical axis while allowing orbital motioning of said footrest 20 via the center hydraulic cylinder ball joint 16. The first upper shaft 14 and lower support post 15 provide a vertical attachment means thereto the footrest portion 20 and base portion 11, respectively. The first upper shaft 14 extends downwardly therefrom the center hydraulic cylinder ball joint 16 which is affixed thereto a bottom surface of the footrest 20 using common fasteners 29. The lower support post 15 provides rigid attachment of the center hydraulic cylinder 13 thereto a base center support portion 12 via the post bracket 18. The base center support 12 comprises a length of rectangular tubing welded thereto inner surfaces of the base 11 thereat an equatorial location passing horizontally through a center point of said circular base 11. The post bracket 18 comprises an inverted "U"-shaped fixture welded thereto the lower support post 15 forming a "T"-shaped weldment and comprising an inner channel-shaped opening having a particular width so as to slidingly fit thereupon the base center support 12. The post bracket 18 provides a removably attachable mounting means via two (2) threaded knob/stud fasteners 33 along a top surface. The matching profile of the post bracket 18 and base center support 12 provides a stabilizing means thereto the apparatus 10. Said base center support 12 is envisioned to provide a rigid connection to the base 11 preferably using a welding process; however, may be affixed using equivalent fastening methods such as bolts, screws, or the like. The base center support 12, first upper shaft 14, lower support post 15, and post bracket 18 are envisioned to be made using rugged metal materials similar to the aforementioned base portion 11.

Figure 3:
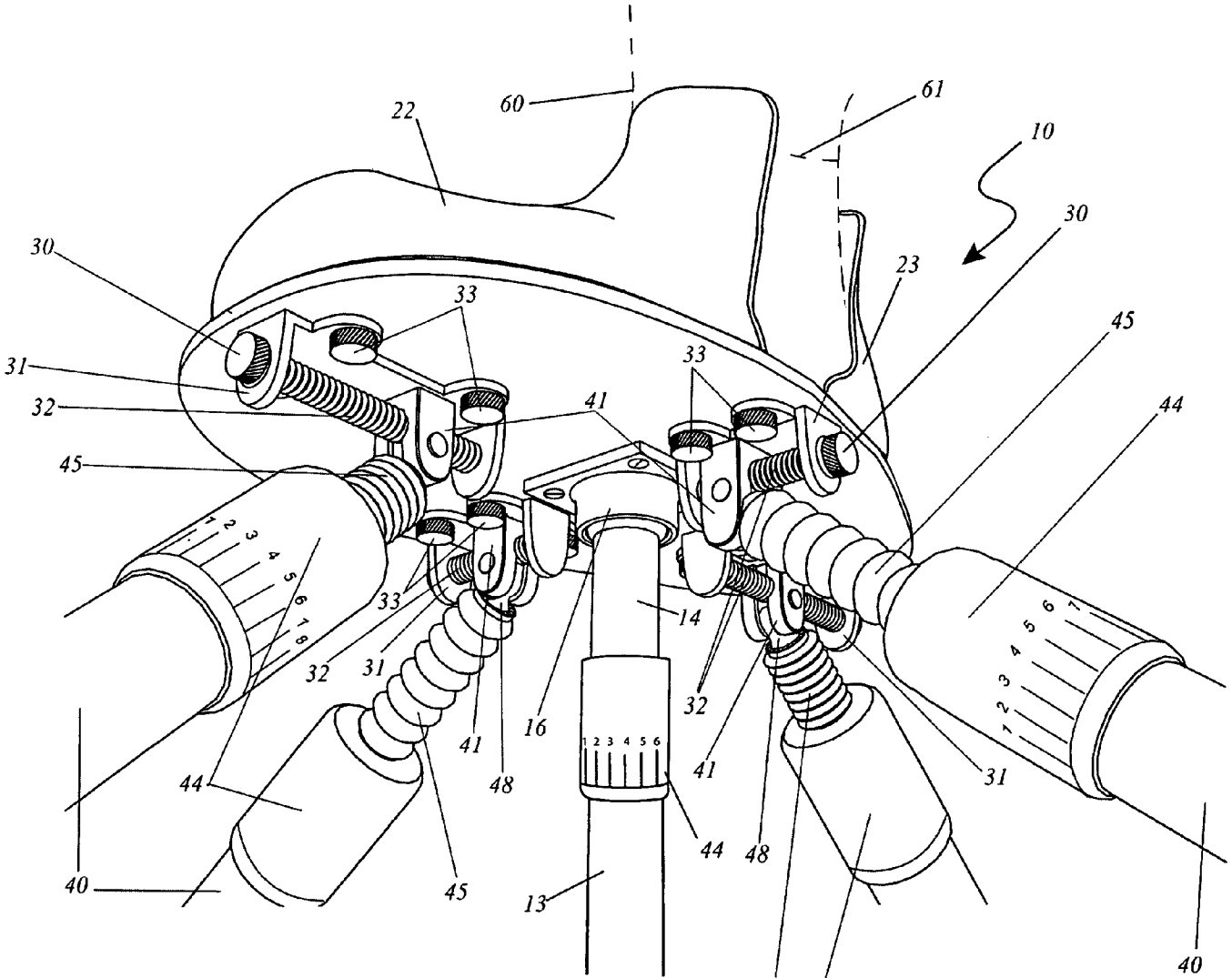
FIG. 3 is an upward looking view of a footrest portion 20 of the shock absorber ankle exerciser 10, according to the preferred embodiment of the present invention.

Referring now to FIG. 3, an upward looking view of the footrest portion 20 of the shock absorber ankle exerciser 10, according to the preferred embodiment of the present invention, is disclosed. The apparatus 10 comprises a center hydraulic cylinder ball joint 16, four (4) cylinder adjustment knobs 30, four (4) cylinder adjustment brackets 31, four (4) cylinder adjustment rods 32, eight (8) bracket knob/stud fasteners 33, and four (4) cylinder adjustment swivel joints 41.

The center hydraulic cylinder ball joint 16 is secured thereon the center hydraulic cylinder 13 at an upper end providing a secured connection thereto the footrest 20 via the post bracket 18 at a central location (see FIG. 2). The center hydraulic cylinder ball joint 16 supports an omni-directional pivoting motion of the footrest 20, thereby providing optimum strengthening, conditioning, and rehabilitation of a foot/ankle portion 60.

The four (4) cylinder adjustment brackets 31 provide an attachment means therebetween the four (4) outer hydraulic cylinders 40 and the footrest 20. Each cylinder adjustment bracket 31 comprises a removably attachable means thereto a bottom surface of the footrest 20 via four (4) knurled bracket knob/stud fasteners 33. The cylinder adjustment brackets 31 comprise "U"-shaped fixtures having holes drilled therein opposing end portions to rotatingly receive the threaded cylinder adjustment rod 32. The cylinder adjustment rod 32 further comprises an integral knurled cylinder adjustment knob 30 located thereat an outwardly facing end portion providing a manual rotating means thereto the cylinder adjustment rod 32. The cylinder adjustment rod 32 provides a threaded attachment thereto the cylinder adjustment swivel joint 41 so as to motion said cylinder adjustment swivel joint 41 in a linear direction by rotating the cylinder adjustment knob 30. The cylinder adjustment swivel joint 41 comprises a machined metal fixture providing a clevis attachment means providing an orbital connection thereto the upper ball end joint portion 48 attached thereto the second upper shaft portion 45 of the outer hydraulic cylinders 40 using standard fasteners such as a press-fit pin, rivet, bolt, or the like. The upper ball end joint 48 is envisioned to be a commercially available hardware item common in the industry. The cylinder adjustment swivel joint 41 further comprises a threaded hole therethrough designed to receive the cylinder adjustment rod 32. The cylinder adjustment swivel joint 41 travels along the length of the cylinder adjustment rod 32 as said rod 32 is rotated clockwise or counter-clockwise utilizing the cylinder adjustment knob 30, thereby providing angular adjustment of each outer hydraulic cylinder 40. Adjusting the angle of the outer hydraulic cylinder 40 produces different compression ratios of the outer hydraulic cylinder 40 with regards to a motion of the user's foot/ankle 60, thereby providing a plurality of resistance levels.

Figure 4:
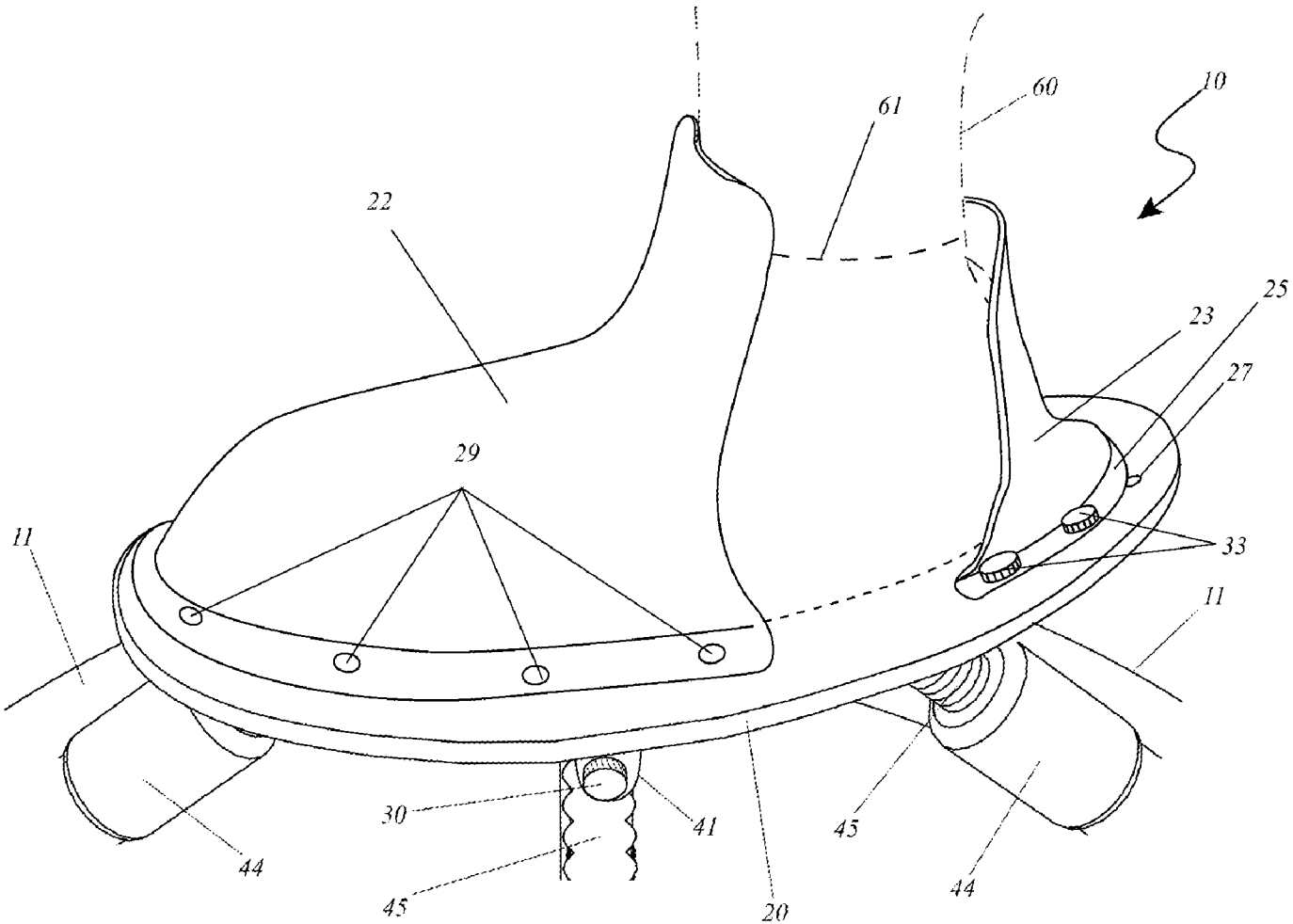
FIG. 4 is a close-up perspective view of the footrest portion 20 of a shock absorber ankle exerciser 10, according to the preferred embodiment of the present invention.
Figure 5:
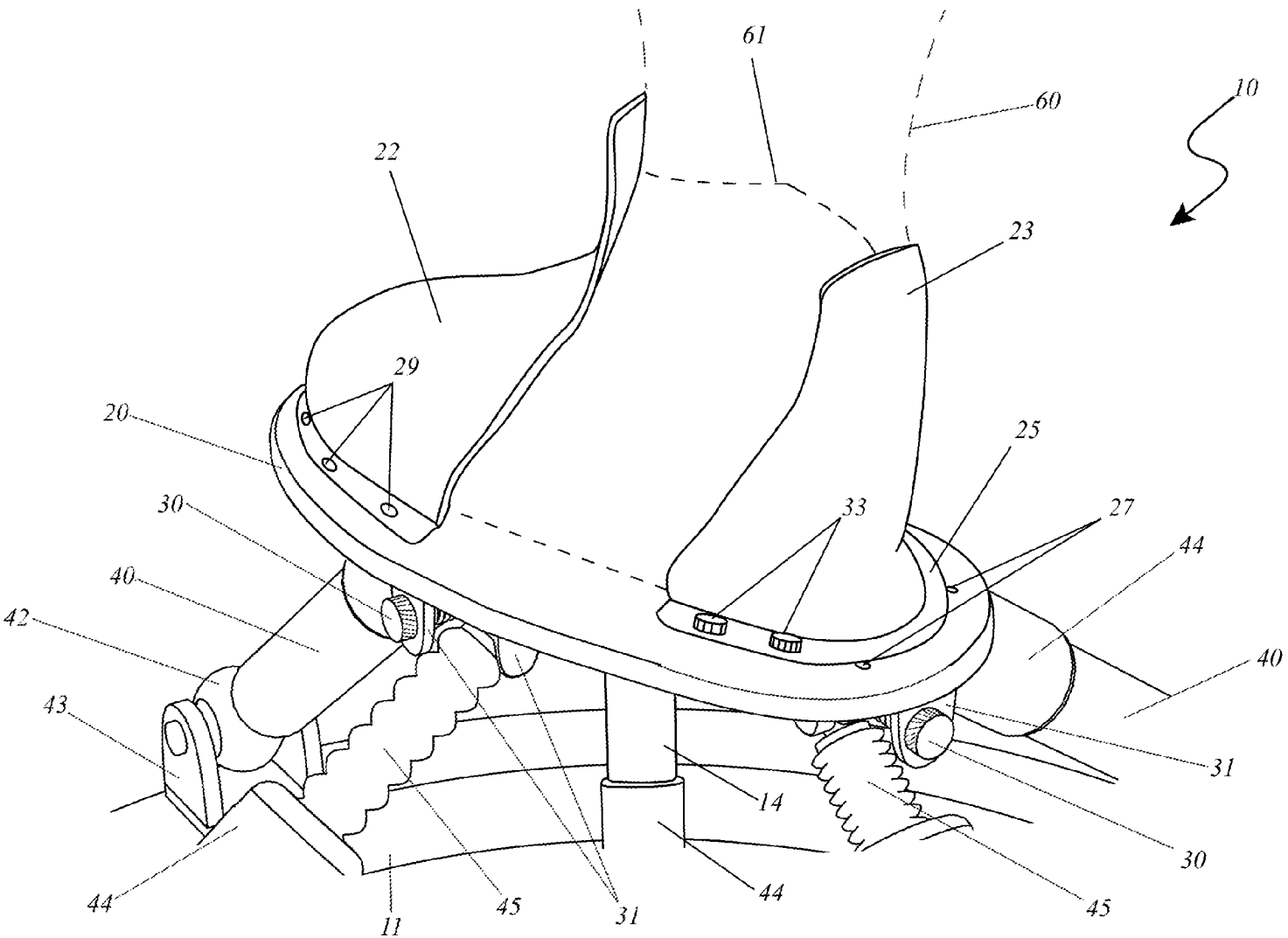
FIG. 5 is a close-up perspective view of a footrest portion 20 of a shock absorber ankle exerciser 10 illustrating a heel area, according to the preferred embodiment of the present invention.

Referring now to FIGS. 4 and 5, close-up side and rear perspective views of the footrest portion 20 of the apparatus 10, according to the preferred embodiment of the present invention, is disclosed. The apparatus 10 comprises a footrest 20, a toe cuff 22, and a heel cuff 23. The footrest 20 provides a means to receive a left or right shoe portion 61; however, may also receive a left or right foot/ankle portion 60 without socks and/or shoes 61. The footrest 20 is envisioned to be a flat plate approximately one-quarter (¼) to one-half (½) inch thick comprising an oval shape approximately fourteen (14) inches long and seven (7) inches wide. The footrest 20 is further envisioned to be made using metal or durable plastic suitable to support a user's weight 100.

The toe cuff 22 is stationarily attached along a front top portion of the footrest 20 being mounted therealong a front perimeter edge of said footrest 20 using common fasteners 29 such as rivets, screws, or the like. The toe cuff 22 provides an enveloping and securing means thereto the shoe 61 or foot/ankle 60 portions. The toe cuff 22 is envisioned being made using a flexible rubber or plastic material capable of conforming thereto a profile of toe portion of a shoe 61 or foot/ankle 60 in a comfortable manner. However, other durable and comfortable materials may be provided such as fabric, leather, cloth-lined vinyl, or the like, being suitable for direct contact with a user's skin 100. Also attached along the top surface of the footrest 20 thereat an opposing rear portion is the heel cuff 23 which provides a adjustable securing means, thereby enabling easy attachment of the apparatus 10 thereto different length shoes 61 or feet/ankles 60. The heel cuff 23 is envisioned being made using similar materials as the toe cuff 22, thereby providing a flexible enclosure therearound a shoe 61 or foot/ankle 60. The heel cuff 23 further comprises four (4) knob/stud fasteners 33, a heel cuff base 25, and a plurality of heel cuff anchoring apertures 27. The heel cuff 23 may be incrementally positioned along the footrest 20 and secured thereto the threaded heel cuff anchoring apertures 27 which are arranged in two (2) parallel rows, using the knob/stud fasteners 33. Due to the flexible nature of the toe 22 and heel 23 cuffs, after initial adjustment and anchoring of the heel cuff 23, a user 100 is able to simply insert their shoe 61 or foot/ankle 60 thereinto and utilize the apparatus 10.

Referring now to FIG. 6*a*, an environmental view of the apparatus 10 depicting attachment of a platform base portion 20, according to the preferred embodiment of the present invention, is disclosed. The apparatus 10 further comprises a removably attachable platform assembly 70 providing a means to further stabilize the apparatus 10 therealong a floor surface. The platform assembly 70 further comprises a "T"-shaped stabilizing handle assembly 85 providing a convenient grasping appendage being vertically adjustable, thereby aiding a user 100 while in various exercise or therapeutic positions such as standing (shown here), sitting, stooping, or the like. Additionally, the platform assembly 70 comprises a pair of weight posts 80 on which standard disc-shaped weights 82 may be applied to obtain even further stability.

Referring now to FIG. 6*b*, a perspective view of a platform base portion 20 of the apparatus 10, according to the preferred embodiment of the present invention, is disclosed. The platform assembly 70 further comprises a first platform portion 72, a second platform portion 74, a platform hinge 76, eight (8) wing bolt fasteners 78, eight (8) wing bolt apertures 79, a pair of weight posts 80, a stabilizing handle assembly 85, and a pair of mounting brackets 87. The platform assembly 70 is divided thereinto the first 72 and second 74 platform portions forming two (2) metal or rugged plastic semi-circular panels having a joining piano-type platform hinge 76 therealong a common straight edge, thereby facilitating folding and compact storage thereof in a closet, vehicle, or the like. Each platform portion 72, 74 further comprises a semi-circular anti-skid pad 75 therealong an entire bottom surface being made using a high-friction material such as rubber and affixed thereto using a common fastening means such as adhesives, rivets, or the like.

The platform portions 72, 74 provide an attachment means thereto the base portion 11 via a plurality of wing bolt fasteners 78 and corresponding wing bolts apertures 79 arranged along a top surface being sized to threadingly receive the corresponding wing bolt fasteners 78 therein. Said wing bolt apertures 79 and wing bolt fasteners 78 are correspondingly aligned thereto the aforementioned base anchoring aperture portions 19 of the base 11, thereby allowing mounting of said base 11 thereto the platform assembly 70 via alignment of the base anchoring apertures 19 therewith the wing bolt apertures 79, followed by threading and securing of the wing bolts 78. The platform portions 72, 74 further provide an attachment means thereto the weight posts 80 using welding processes or common fasteners such as bolts, screws, or the like. Said weight posts 80 comprise cylindrical appendages approximately eight (8) inches high being capable of holding a plurality of standard disc-shaped weights 82 for increased stability.

The platform assembly portion 70 of the apparatus 10 further comprises a stabilizing handle assembly 85 extending upwardly therefrom providing a secure grasping means thereto a user 100. The first 72 and second 74 platform portions each provide respective mounting brackets 87 comprising a threaded attachment thereto said stabilizing handle assembly 85 at opposing perimeter positions of the platform assembly 70, thereby allowing a choice of mounting configurations of the stabilizing handle assembly 85 based upon left or right foot/ankle 60 application or a user's 100 preference. The mounting brackets 87 are securely affixed thereto respective platform portions 72, 74 using common fasteners 29 and comprise common flange-style devices having a center female threaded region 88 to threadingly engage the stabilizing handle assembly 85. The stabilizing handle assembly 85 provides a secure tubular structure sufficient to provide aided mobility and stability to a user 100 during initial engagement of the apparatus 10 and during exercise and/or therapeutic use thereof. The stabilizing handle assembly 85 provides a telescoping "T"-shaped vertical appendage comprising a rugged assembly of metal tubular members including an upper handle member 89, a lower handle member 91, a locking collar 93, and a pair of grips 95. The mounting brackets 87 provide a threaded attachment means thereto a corresponding male threaded portion therealong a bottom portion of the lower handle member portion 91. The lower handle member portion 91 comprises a straight length of tubing approximately two (2) feet long which provides a telescoping attachment thereto the upper handle member 89 via the locking collar 93. The locking collar 93 comprises a rotary clamping device similar to like devices used on photographic tripods. The locking collar 93 enables a user 100 to vertically adjust the height and orientation of the stabilizing handle assembly 85 and subsequently secure in place by twisting said locking collar 93. The upper handle member 89 comprises a tubular weldment which extends upwardly therefrom the locking collar 93 thereto a "T"-shape extending horizontally in both directions providing common tubular grips 95 similar to like devices used on bicycle handlebars being affixed thereto outer end portions of said upper handle member 89 via a friction fit or adhesive bonding.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention is designed to be used by the common consumer with little or no special skills and a minimum of experience and training, if necessary, by an experienced athletic trainer, therapist, or physician. After initial purchase or acquisition of the apparatus 10, it would be installed as indicated in FIG. 1.

The method of utilizing the apparatus 10 may be achieved by performing the following steps: mounting the footrest assembly 20 thereto the cylinder adjustment brackets 31 using the knurled knob/stud fasteners 33; mounting the center hydraulic cylinder 13 thereto the base center support 12 by fastening the post bracket 18 using the knob/stud fasteners 33; configuring the apparatus 10 therewith the platform assembly 70, if desired, by deploying the folded first 72 and second 74 platform portions thereinto a flat coplanar form using the platform hinge 76; mounting the base portion 11 thereto said first 72 and second 74 platform portions using the wing bolt fasteners 78; adding weights 82 thereto one (1) or both of the weight posts 80, as desired, to obtain additional stability such as when utilizing the apparatus 10 while in a standing position; affixing the stabilizing handle assembly 85 thereto one (1) of two (2) available mounting brackets 87; adjusting the height and/or orientation of the upper handle member 89 thereto a desired position; removing the heel cuff 23 therefrom the foot rest 20 by removing the knob/stud fasteners 33 affixed thereto; selecting a desired left or right foot/ankle member 60 to be exercised and/or rehabilitated; inserting a shoe 61 or foot/ankle member 60 thereinto the toe cuff 22; placing the heel cuff 23 thereagainst a heel portion of the shoe 61 or foot/ankle member 60; positioning the heel cuff so as to ensure a snug fit; adjusting and affixing said heel cuff 23 thereto the footrest 20 by threadingly engaging the knob/stud fasteners 33 thereinto aligned heel cuff anchoring apertures 27; adjusting the angle and amount of resistance provided by the outer hydraulic cylinders 40 by adjusting the cylinder adjustment knobs 30 and the resistance adjustment collars 44; adjusting the resistance provided by the center hydraulic cylinder 13 by adjusting the resistance adjustment collar 44; engaging the apparatus 10 in either a sitting or standing position; utilizing the stabilizing handle assembly 85 to obtain needed leverage, mobility, stability, and/or security; moving the shoe 61 or foot/ankle member 60 in desired orbital or linear movements, thereby isolating particular muscles and/or joints involved in plantarflexion, inversion, eversion, and/or dorsiflexion; adjusting the angle and resistance of the hydraulic cylinders 13, 40 incrementally during a session if desired; repeating the exercise and/or therapeutic treatment thereon the remaining foot/ankle 60 as needed; removing the shoe 61 or foot/ankle member 60 therefrom the apparatus 10 upon completion of said exercise or therapeutic treatment; and, benefiting from exercise and/or rehabilitation of one's foot/ankle(s) 60 using the present invention 10.

The apparatus 10 may be prepared for compact storage by performing the following steps: removing the weights 82 therefrom the weight posts 80; detaching the stabilizing handle assembly 85 therefrom the mounting bracket 87; detaching the base 11 therefrom the first 72 and second 74 platform portions by loosening and removing the wing bolts 78 therefrom; detaching the footrest portion 20 by loosening and removing the knob/stud fasteners 33 therefrom the cylinder adjustment brackets 31 and the post bracket 18; folding the outer hydraulic cylinders 40 thereto a flat and compact position upon the base 11; storing the apparatus 10 in a closet, vehicle, or the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An ankle exercising device for rehabilitating lower leg muscles, said ankle exercising device comprising:

a base member having a planar bottom surface with an annular shape, further comprising:

a rectilinear center post spanning across a diameter of said base member, a friction pad attached thereto a bottom surface thereof, and, a plurality of base anchoring apertures, wherein said rectilinear center post provides additional structural rigidity thereto said base member;

a plurality of outer adjustable hydraulic cylinders adaptable along an orbital direction and directly coupled to said base member in such a manner that top ends of said plurality of outer hydraulic cylinders converge upwardly towards a center of said base member;

an adjustable footrest assembly supported above said base member and operably engaged with said plurality of outer hydraulic cylinders;

an outer attaching means for attaching said plurality of outer hydraulic cylinders to said footrest assembly and said base member;

a center hydraulic cylinder adaptable along a central vertical axis and directly coupled to said base member, wherein said center hydraulic cylinder further comprises:

a center shaft resiliently compressible along a linear path extending downwardly from said footrest assembly, an upper center ball end joint having a downwardly extending upper shaft coupled to said center shaft, an external center resistance adjustment mated to said center shaft, a post bracket anchored to said center post, having a vertically upstanding lower support post thereby connecting said center hydraulic cylinder to said base member, and, an internal compression spring providing an upward pressure thereto said footrest portion, wherein said external center resistance adjustment includes a cylindrical center collar located along an external surface of a center hydraulic cylinder body for adjusting a tension of said center hydraulic cylinder body;

a platform assembly removably attachable thereto said base member, wherein said plurality of base anchoring apertures provides a base attachment means thereto said platform assembly therewith a plurality of fastening means; and, a stabilizing handle removably attachable thereto said platform assembly and extending upwardly therefrom;

wherein each of said plurality of outer hydraulic cylinders are independently compressible along a linear path based upon an external force exerted by the user during movement along the orbital direction.

2. The ankle exercising device of claim 1, wherein each of said plurality of outer hydraulic cylinders are equidistantly spaced from each other, further comprising:

a shaft resiliently compressible along a linear path angled outwardly and downwardly from said footrest assembly;

an external resistance adjustment mated to said shaft; and, a lower ball end joint anchored to said base member;

wherein said external resistance adjustment includes a cylindrical collar located along an external surface of a hydraulic cylinder body for adjusting a tension of said hydraulic cylinder body.

3. The ankle exercising device of claim 2, wherein said outer attaching means comprises:

a plurality of upper ball end joints coupled to said shafts, respectively;

a plurality of cylinder adjustment swivel joints mated to said upper ball end joints, respectively;

a plurality of adjustment brackets secured to said footrest assembly;

a plurality of knurled attachment knobs operably attached to said adjustment brackets;

a plurality of adjustment rods threadably connected to said adjustment brackets; and, a plurality of adjustment knobs coupled to said adjustment rods;

wherein said cylinder adjustment swivel joints travel along respective lengths of said adjustment rods as said adjustment rods are rotated clockwise or counter-clockwise by utilizing said adjustment knobs to thereby provide angular adjustment of said plurality of outer hydraulic cylinders; and, wherein each of said adjustment brackets have distal ends terminating within a perimeter of said footrest assembly.

4. The ankle exercising device of claim 3, further comprising:

a toe cuff stationarily attached to a top front portion of said footrest assembly and comprising a flexible panel for receiving a front portion of user's foot; and, a heel support member adjustably attachable to a rear portion of said footrest assembly with a length adjustable means and comprising a flexible panel for receiving a heel portion of said user's foot;

wherein said toe cuff comprises an enveloping and securing means to a front of said user's foot inserted therein;

wherein said heel support member envelops and secures a heel portion of said user's foot inserted therein; and, wherein said length adjustable means provides a user to selectively adjust said heel support member to a desired length of said user's foot.

5. The ankle exercising device of claim 4, wherein said length adjustable means further comprises:

a heel cuff base, comprising a plurality of first apertures;

a plurality of fasteners; and, a plurality of heel cuff anchoring apertures located thereat said rear portion of said footrest assembly;

wherein each of said plurality of fasteners fastens said heel cuff base thereto a corresponding anchoring aperture.

6. The ankle exercising device of claim 5, wherein said platform assembly further comprises:

a first platform portion hingedly attached thereto a second platform portion, thereby forming a circular panel with a diameter larger than said base member;

a semi-circular anti-skid pad affixed therealong an entire bottom surface thereof each of said first platform portion and said second platform portion;

a pair of stabilizing handle mounting brackets each located at an outer perimeter portion of said first platform portion and said second platform portion, respectively; and, a pair of weight attachment means each comprising a cylindrical appendage extending vertically upward from said first platform portion and said second platform portion, respectively;

wherein said platform assembly further stabilizes said device; and, wherein said pair of weight attachment means are each capable of holding a plurality of standard disc-shaped weights for increased stability.

7. The ankle exercising device of claim 6, wherein said stabilizing handle comprises a tubular telescoping vertical appendage, further comprising:

a lower handle member providing a stabilizing handle attachment means thereto either one of said pair of stabilizing mounting brackets;

a "T"-shaped upper handle member, comprising a horizontally extending first handle and second handle;

a locking collar comprises a rotary clamping device and a height adjustment means thereof said upper handle member thereto said lower handle member; and, a pair of grips affixed thereto outer end portions of each of said first handle and said second handle, respectively;

wherein said stabilizing handle provides a grasping appendage thereto a user; and, wherein said stabilizing handle is selectively attached thereto either of said pair of stabilizing handle mounting brackets.

* * * * *